US006076762A

United States Patent [19]

Dörfel et al.

[11] Patent Number: 6,076,762

[45] Date of Patent: Jun. 20, 2000

[54] RIDER ROLLER ASSEMBLY

[75] Inventors: G. Walter Dörfel, Boll; Gaston Boehm; Bernd Görner, both of Weilheim, all of Germany

[73] Assignee: Beloit Technologies, Inc., Wilmington, Del.

[21] Appl. No.: 08/930,842

[22] PCT Filed: Jun. 6, 1996

[86] PCT No.: PCT/EP96/01877

§ 371 Date: Feb. 23, 1998

§ 102(e) Date: Feb. 23, 1998

[87] PCT Pub. No.: WO96/34818

PCT Pub. Date: Nov. 7, 1996

[51] Int. Cl.[7] ..... B65H 18/14; B65H 18/26

[52] U.S. Cl. ..... 242/541.6; 242/547

[58] Field of Search ..... 242/541.6, 542, 242/547, 534

[56] References Cited

U.S. PATENT DOCUMENTS

| | | | |
|---|---|---|---|
| 2,851,869 | 9/1958 | Quoos et al. | 68/258 |
| 3,206,134 | 9/1965 | Printz et al. | 242/66 |
| 3,602,448 | 8/1971 | Muensterer | 242/55 |
| 3,648,342 | 3/1972 | Dörfel | 29/125 |
| 3,762,280 | 10/1973 | Kreuter et al. | 92/98 |
| 3,837,593 | 9/1974 | Dörfel | 242/66 |
| 4,095,755 | 6/1978 | Syngg et al. | 242/66 |
| 4,165,843 | 8/1979 | Wedig et al. | 242/66 |
| 4,281,589 | 8/1981 | Stoll | 92/109 |
| 5,320,299 | 6/1994 | Fitzpatrick et al. | 242/66 |

FOREIGN PATENT DOCUMENTS

| | | |
|---|---|---|
| 357 861 | 2/1977 | Austria . |
| 2362291 | 3/1978 | France . |
| 1 233 689 | 3/1963 | Germany . |
| 1 965 299 | 12/1969 | Germany . |
| 2 147 673 | 9/1971 | Germany . |
| 27 29 346 A1 | 6/1977 | Germany . |
| 27 51 430 A1 | 11/1977 | Germany . |
| 37 13 648 A1 | 4/1987 | Germany . |
| 42 01 327 A1 | 1/1992 | Germany . |

*Primary Examiner*—John Q. Nguyen

[57] ABSTRACT

A rider roller assembly includes a beam being translationally moveable substantially vertically relative to a paper web roll being wound. A rider roller in the assembly includes a plurality of rider roll wheels which are mounted to the beam and are individually pivotable so as to engage the wound roll along a nip line. A plurality of supporting arms are articulately linked with the beam for supporting and individually pivoting the rider roll wheels on a swiveling axis in relation to the beam. The individual rider roll wheels are individually loaded against the paper web roll. Double-acting piston/cylinder units are connected to the rider roll wheels for lifting or compensating the rider roll wheels.

4 Claims, 3 Drawing Sheets

29'
27'
28'
30'
34
25'
44
42
41
43
45
26'
31'
22'
36'
16
33
32
32'
32''
24'
35
23',23''
32'''
34
40'
39
18
17',17''
21'
19

RIDER ROLLER ASSEMBLY

BACKGROUND OF THE INVENTION

1. Field of the Invention

The invention pertains to a rider roller assembly for exerting a load force to at least one wound roll of a web-like material, such as at least one roll of paper, during the winding in a winder comprising at least one supporting or carrier drum, supporting or carrying the wound roll being rotary-driven on its axis of rotation, with the features according to the preamble of claim 1.

2. Description of the Prior Art

A generic rider roller assembly comprises a support beam for translational movement, which is substantially vertically movable relative to the wound roll depending on the diameter thereof, driving means for moving the beam, a rider roller including a plurality of individual rider roll wheels, which are rotatably mounted to the beam and are capable to engage the wound roll along a contact line (nip line), supporting arms, which are articulately linked to the beam for holding and independently pivoting the rider roll wheels on a swiveling axis relative to the beam, pressing means for hydraulically pressing the rider roll wheels against the at least one wound roll, and means for pneumatically balancing out or lifting the rider roll wheels from the at least one wound roll counter-balancing the pressing means, and optionally, counter-balancing the weight of the rider roll wheels.

Generic rider roller assemblies are known from U.S. Pat. No. 5,320,299. By virtue of its citation, the disclosure of this document is fully incorporated in the disclosure of the present description.

In this known rider roller assembly, the pivoting of the individual rider roll wheels on its associated supporting arms each is effected by means of a piston rod, which is loaded at each end by piston/cylinder units, the middle section of which has a joint for pivotable link with the associated supporting arm. It has been shown that these known rider roller assemblies already represent a significant advance in improvement of the windings of the wound roll. However, the piston/cylinder units acting on the same piston rod at both ends must be exceptionally precisely aligned. Further more, the corresponding supporting arm transmits a transverse force to the piston rod due to its pivoting on its swiveling axis.

AT 357,861 describes a rider roller assembly having a plurality of rider roll wheels each rigidly fixed to one end of a piston rod. The rider roll wheels are moved in the axial direction of the piston rod by means of a hydraulically actuated elements, serving also as vibration dampers.

DE 21 47 673 discloses a roller assembly having a plurality of rider roll wheels being pivotably mounted by means of lever elements to a beam, wherein pressure chambers fluidly connected with each other are arranged inside the beam. To cause pivoting of the roll wheels, the pressure chamber is linked via membranes to the lever elements.

SUMMARY OF THE INVENTION

It is an object of this invention to provide a rider roller assembly which is capable of having as many rider roll wheels as possible disposed at a generic rider roller assembly wherein the reaction accuracy to a given load program depending on the diameter of the wound roll is improved.

These objects are achieved with a rider roller assembly comprising the features according to claim 1.

In the rider roller assembly according to the invention, the means for loading, on the one hand, and for lifting or balancing out the rider roll wheels, on the other hand, are combined in double-way acting piston/cylinder units with single-sided piston rods; inserted between the free end of each piston rod and the corresponding supporting arm of the rider roll wheels may be at least one compensating means, which enables a relative movement, independent of the axial movement of the piston rod, between the supporting arm and the piston rod in the radial direction in relation to the piston rod.

In the rider roller assembly according to the invention, the friction-related load of the piston rod is exceptionally low, so that even slight deviations between the pressing forces and the counter-acting forces for pressing, compensating or lifting effect a change of the nip load between the corresponding rider roll wheel and the loaded wound roll.

Practical modifications of the subject of the invention, which specifically ensure a high level of operational safety and simple change of individual rider roll wheels or corresponding piston/cylinder units and ensure an improved life span of the rider roller assembly, are set forth in further claims.

The components, as mentioned above and/or as claimed and described in the description of the preferred embodiments, which are to be used in the invention, are not subject to any special exception provision as to size, configuration, choice of material, or technical concept, so that they can be used in the given field of application without restriction to known selection criteria.

These, and other objects, features and advantages of this invention will become more apparent to those skilled in the art upon reading the description of the preferred embodiments in conjunction with the attached drawings.

DESCRIPTION OF THE PREFERRED EMBODIMENTS

Figure 1:
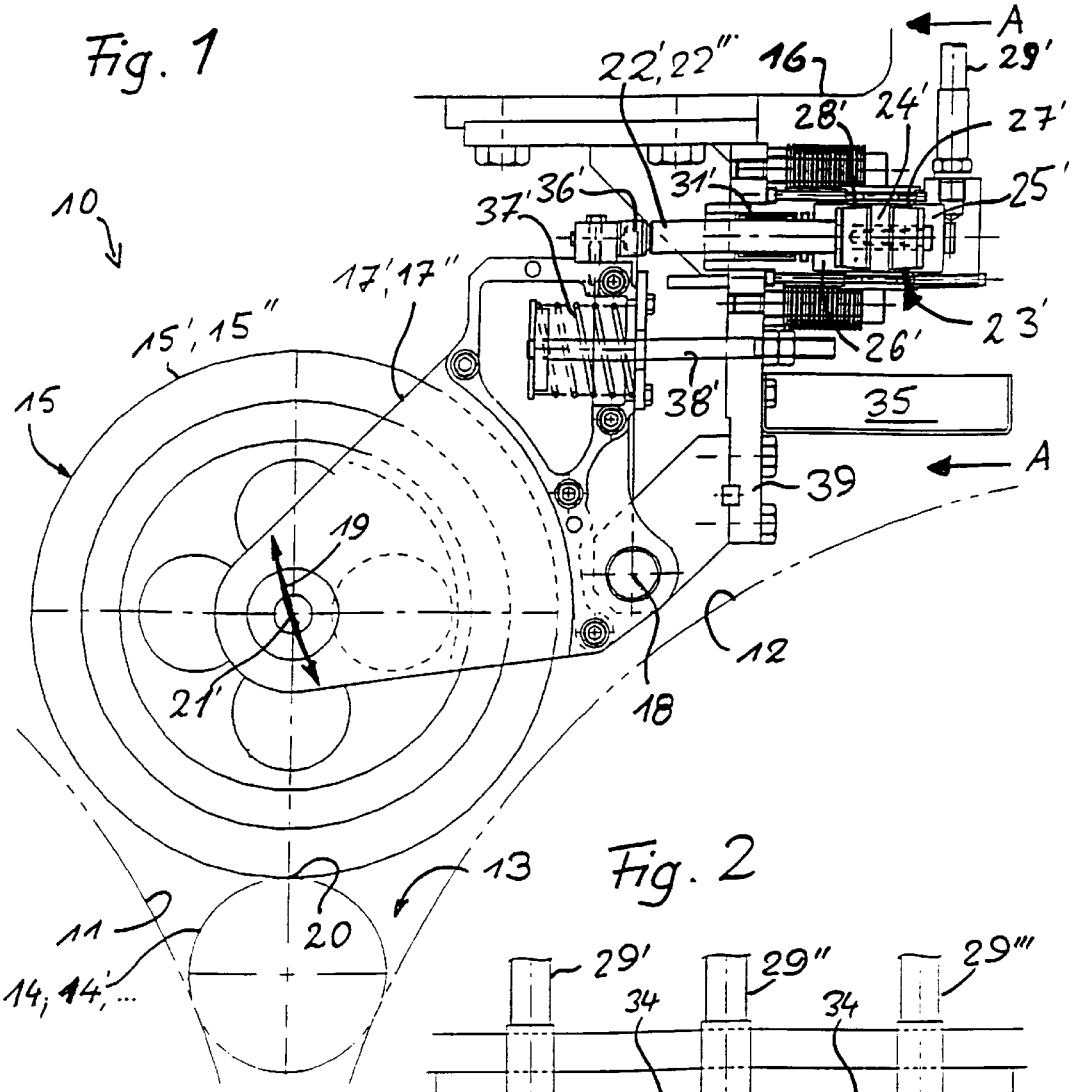
FIG. 1, schematically shows a first embodiment of a rider roller assembly in a side view of one of the ends of a winder.

With reference to FIG. 1, a winder, generally designated by numeral 10, comprises supporting drums 11,12 which are shown in dashed lines. In the upper nip area between these supporting drums is a winding bed 13, in which one or more aligned rolls 14 of a web-like material, e.g., at least one roll of paper, are wound on cores or winding sleeves inserted at the start of each winding operation.

For applying a defined linear pressure to the winding sleeve and the webs of material to be wound thereon, a rider roller 15 is arranged parallel to the axis of the supporting drums 11,12 above the winding bed 13. It comprises a number of rider roll wheels 15', 15", . . . , such as those known in detail from U.S. Pat. No. 5,320,299, arranged one beside the other in the longitudinal extension of the rider roller.

A support beam 16 is movable upwardly and downwardly, substantially vertically relative to the wound roll 14 depending on the diameter thereof in a known manner. The driving means for moving the supporting beam are not shown in the drawing since they are known from prior art. The beam movement may also be effected along a curve being freely programmable or being an arc of a circle.

A number of supporting arms 17', 17", . . . is mounted to the supporting beam, the supporting arms for each of the rider roll wheels being independently from each other pivotable on a swiveling axis 18 relative to the beam 16 from the midstroke position of the rider roll wheels 15', 15", . . . by a sufficient angle (double arrow 19). Each supporting arm or each pair of supporting arms supports one of the rider roll wheels 15', 15", . . . , which is/are mounted being rotatable on their axis 21', 21", . . . relative to the associated supporting arm or pair of supporting arms. Consequently, the corresponding shaft is mounted at one side in one or at both sides in two supporting arm(s).

By means of the (support) beam 16, the rider roll wheels 15', 15", . . . can be raised according to the increasing diameter of the roll/s to be wound and lowered only together. The individual positioning and exerting of load on the roll to be wound is accomplished by means of a (single-sided) piston rod 22',22", . . . acting on the associated supporting arm. The one-sided piston rod is an element of a two-way piston/cylinder unit 23', 23", . . . which is (nearly) rigidly joined to the beam 16.

Each piston rod 22', 22", . . . is rigidly joined to a two-way piston 24', 24", . . ., which is smoothly movable back and forth within a double cylinder 25', 25", . . . ; 26', 26", . . . This smooth operation is supported by the use of at least one, preferably two, diaphragms 27, 28, which, in the depicted and to this extent preferred embodiment, are formed as so-called roll membranes and serve to fluidly separate the two cylinder chambers 25', 25", . . . ; 26', 26", . . . of the double cylinder. The preferably high burst-pressure type of diaphragms support to minimize the cylinder size which enables to achieve a small width per wheel assembly. The pressure area of this two-way cylinder 24', 24", . . . is also reduced.

While the one cylinder chamber 25', 25", . . . is preferably hydraulically chargeable via a conduit 29', 29", . . . the other cylinder chamber 26', 26", . . . is preferably pneumatically chargeable in the opposite direction with compressed air via a pressure connection 30', 30", . . . A roller bearing 31 ensures friction-free bedding of the piston rod 22. For easy mounting/dismounting and secure clamping of the diaphragms, each associated piston housing 32', 32", 32'", . . . , generally designated with 32, is formed in several parts and capable of being assembled with bolts 33.

Symmetrically arranged spring-washer packages 34, which enable the piston housing 32 with the beam 16 to be disposable parallel to the axis of the one-sided piston rod 22', 22", . . . , acting against the pressure of said spring-washer packages 34, provide overload protection for the double-way acting piston/cylinder unit.

Beneath one or several adjoined two-way piston/cylinders unit 23', 23", . . . there is a drip pan 35 for catching any leaking oil for protecting the support drum 12 and the web.

The smooth operation of the piston rods 22 is further enhanced by a compensating means 36 installed between each free end of the piston rod 22', 22", . . . and the associated supporting arm 17', 17", . . . of the rider roll wheel 15', 15", . . . and which is designed to permit a relative movement, independent of the axial movement of the piston rod 22', 22", . . . between the supporting arm 17', 17", . . . and the piston rod 22', 22", . . . in the radial direction in relation to the piston rod. In the embodiment shown in FIG. 1, a spherical pad (item 36') is used as compensating means, which is itself known in the state of the art and fits on the free end of the piston rod without any force-locking or form-fitting connection. It goes without saying that the rider roller assembly according to the invention is also of independent inventive significance without a compensating means.

The weight of each rider roll wheel 15', 15", . . . and the corresponding supporting arm 17', 17", . . . is balanced out in the embodiment depicted in FIG. 1 by a pressure spring 37', 37", . . . , which presses the associated supporting arm against the free end of the corresponding piston rod 22', 22", . . . and is linked by an adjustable tension rod 38', 38", . . . and a retainer elbow 39 to the beam 16. The retainer elbow 39 can also hold more than one double-acting piston/cylinder unit, optionally with intermediate shock absorbers (see FIG. 2).

The functioning of the shown rider roller assembly is such that the pressure in the cylinder chamber 25', 25", . . . in loading operation is greater than the counter pressure of the spring 37', 37", . . . The pressure difference determines the resulting nip load on the roll to be wound. If the hydraulic pressure inadvertently drops, the pressure spring 37', 37", . . . causes the corresponding rider roll wheel to lift automatically away from the roll being wound. For this reason, it is not necessary that the free end of the piston rod 22', 22", . . . be rigidly joined to the associated supporting arm 17', 17", . . .

In the depicted embodiment a compressive force is constantly applied in the axial direction to the piston rod 22', 22", . . . The pressure spring 37', 37", . . . is having a very low spring-ratio in order to keep the nip forces between the supporting drums and the web of material to be wound as equal as possible in the both extreme pivot positions of the supporting arms. For example, the deviation of the nip force of a roll of paper of 1 m in diameter between these two extreme positions is in the range of ±1%. The pressure spring has a dimension such that a lateral buckling is avoided, even when the support surfaces are inclined by more than ±4° from the depicted midstroke position of the carrier arms.

The spring-washer packages 34 functions as shock absorbers to serve as a protection against overload and render a hydraulic storage for each double-way acting piston/cylinder unit unnecessary. The pneumatic cylinder 26', 26", . . . of the double-way acting piston/cylinder units 23', 23", . . . are required only for lifting individual rider roll wheels from the roll to be wound, such as in the slit area between two adjacent webs of material to be wound. When the sum of the compressive forces of the pressure springs 37', 37", . . . and the pneumatic pressure is greater than the hydraulic pressure, the rider roll wheel involved lifts away. Relative radial movements between the single-side piston rod and the associated supporting arm are minimized by the fact that the center of the spherical pad 36', 36", . . . is located exactly vertical above the swiveling axis of the supporting arm 17', 17". . . This supports to prevent a vacuum force acting on the diaphragm 27, i.e. pulling force on the piston rod 22.

Figure 2:
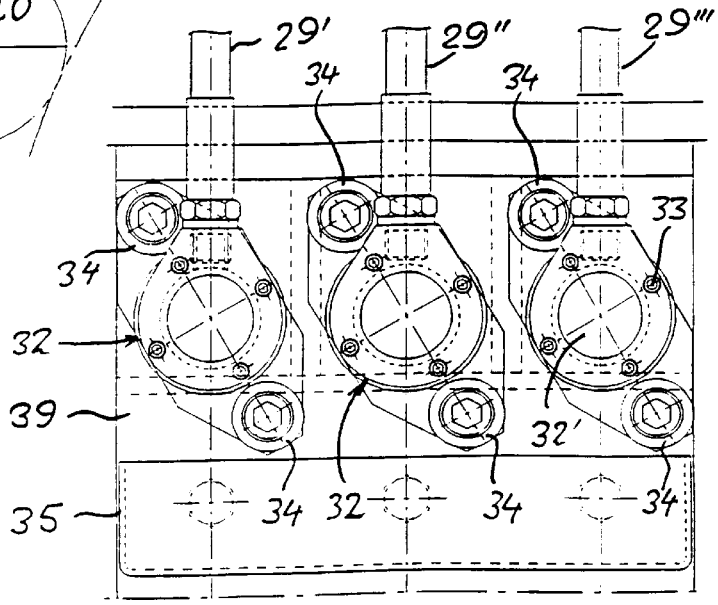
FIG. 2, shows in detail a frontal view of the same rider roller assembly, taken along A-A in FIG. 1.

It is apparent from FIG. 2 that the double-way acting piston/cylinder units 23', 23", . . . permit an extremly closely adjoining arrangement of a number of rider roll wheels.

Figure 3:
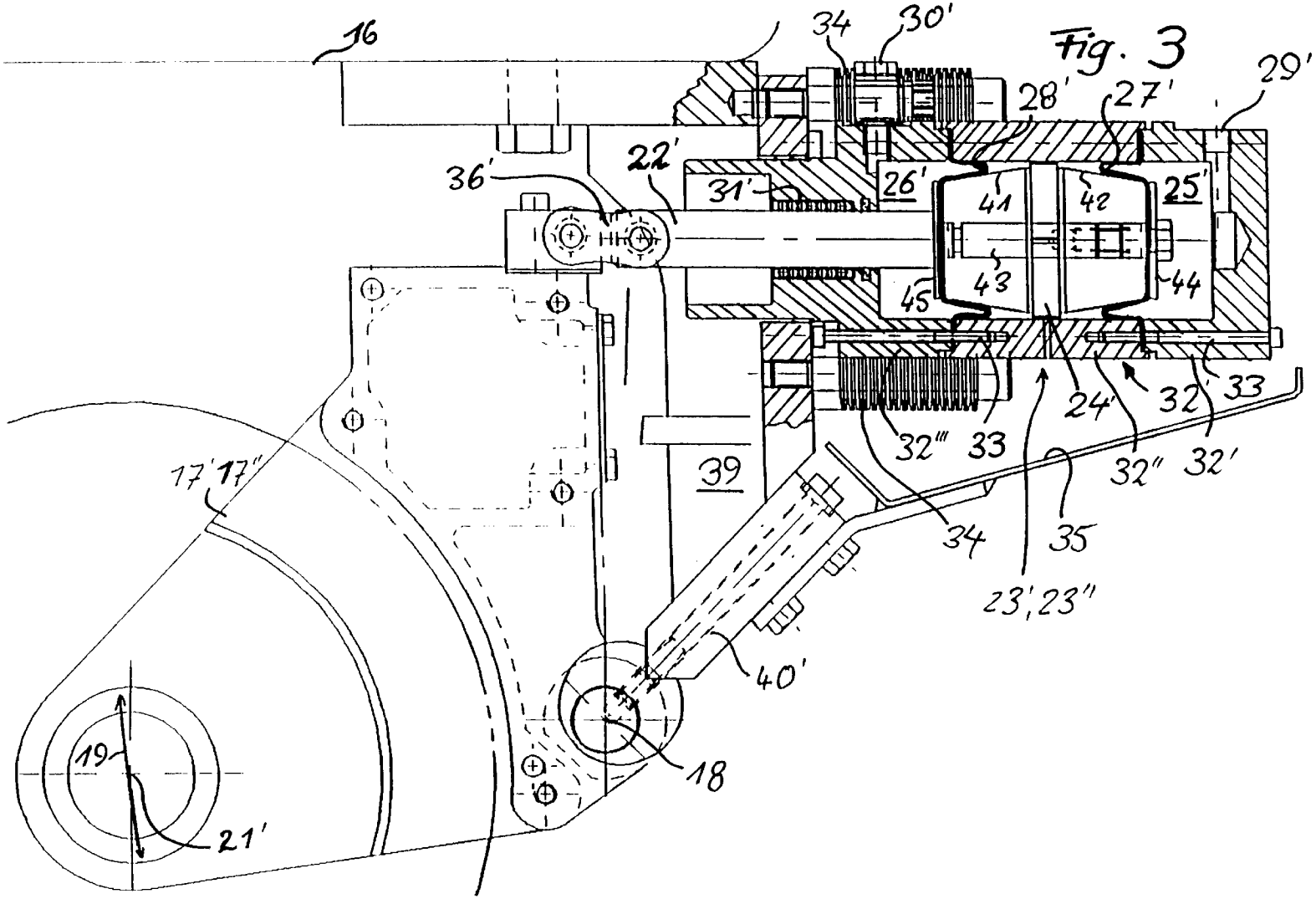
FIG. 3, shows an alternate embodiment of a rider roller assembly in the same presentation as in FIG. 1, partially cut away.

The alternative embodiment shown in FIG. 3 is distinguished from the embodiment depicted in FIGS. 1 and 2 in that the means of compensating or overcompensating the weight-related torque between the rider roll wheels and the supporting arm are dispensed. In this embodiment, also the necessary force components are provided pneumatically via the cylinder chamber 26', 26", . . . Consequently, tensile forces can also develope between the free end of the piston rod 22', 22", . . . and the supporting arm 17', 17", . . . For this reason the compensating means 36', 36", . . . is designed as a traction and tension element joined so as to be pivotable at both sides.

For fastening the diaphragms 27', 27", . . . and 28', 28", . . . on the piston 24', 24", . . . , it is sufficient to screw conical, hollow pieces 41, 42, arranged in opposite directions at both sides of the piston 24', 24", . . . , onto the associated front end of the piston rod 22', 22", . . . and thus secure each diaphragm to the outer side of the base of each hollow piece by means of a washer 44, 45 (FIG. 3).

Due to the effortless sensitivity of the rider roller assembly of the invention, the system reacts precisely to even slight pivoting movements of the individual rider roll wheels. Especially an equal distribution of the load to all of the rider roll wheels is realized, whereby the combined application of pressure to the cylinders 25', 25", . . . is possible within a closed, hydraulic control circuit.

Figure 4:
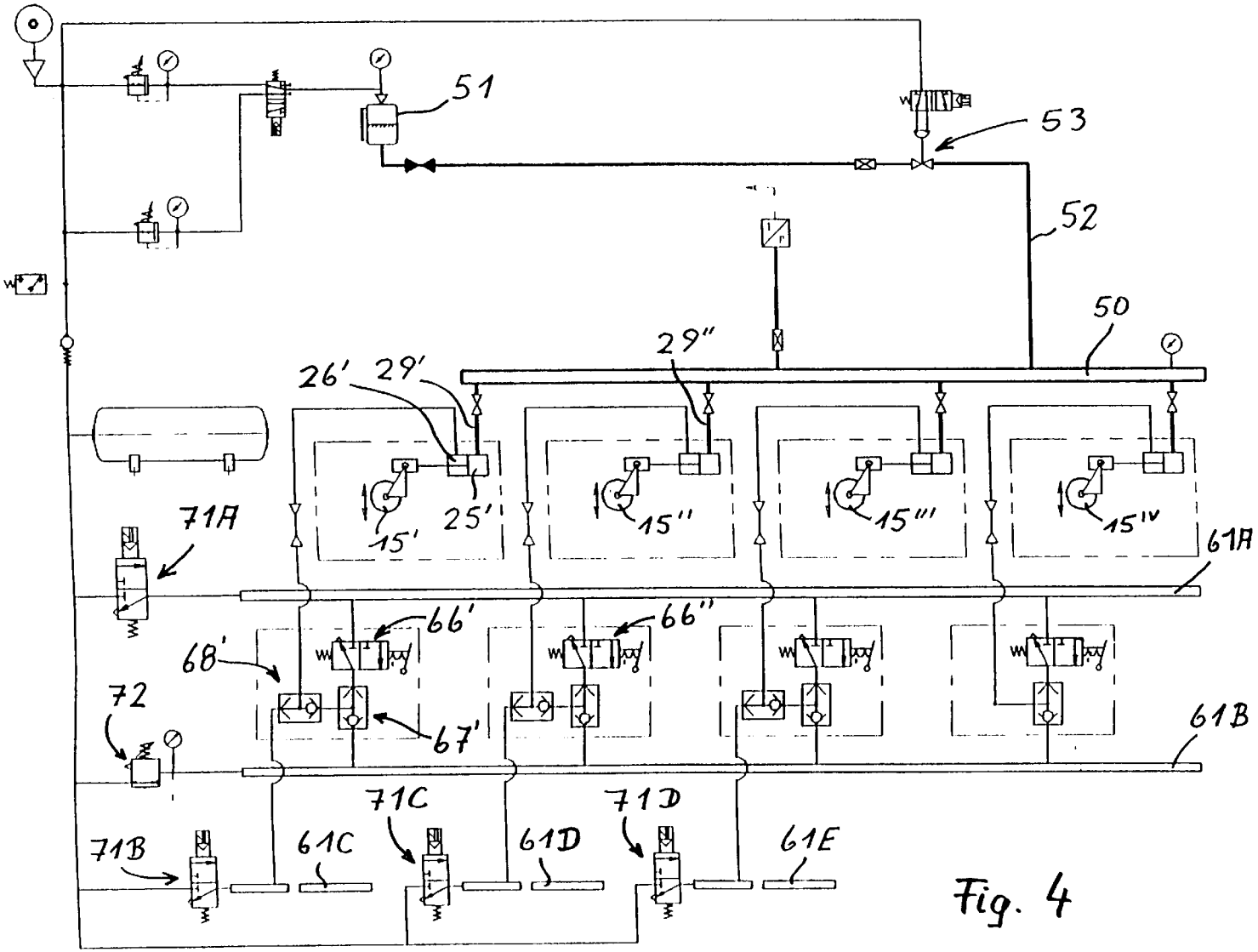
FIG. 4, schematically shows a hydraulic/pneumatic system capable of being used with the rider roll assemly.

A simplificated pneumatic/hydraulic initialization-system for manual wheel selection is shown in FIG. 4. Depending on the number of rider roll wheels installed in the rider roller assembly, only a few, e.g. 4 or 5 solenoid valves are used to initialize the rider roll wheels 15', 15", . . . to the midstroke position, i.e. filling the cycle of the hydraulic side of the double-way acting piston units 23', 23", . . . , for a new rollset pattern.

The system shown in FIG. 4 comprises a hydraulic manifold 50, connecting the conducts 29', 29", . . . of cylinder chambers 25', 25", . . . with each other and with a reservoir 51 for the fluid via conduit 52 and a shut-off valve 53.

The pneumatic cycle comprises five pneumatic manifolds 61A, 61B, 61C, 61D, 61E, wherein manifolds 61A and 61B are connected via manual valves 66', 66", . . . and relief valves 67', 67", . . . and 68', 68", . . . to the cylinder chamber 26', 26", . . . of an associated double-way acting piston/cylinder unit 23', 23", . . . Manifolds 61A, 61C, 61D and 61D are feeded with high pressurized air that can be shut-off by means of solenoid valves 71A, 71B, 71C, 71D while the pressure of the air in manifold 61B is reduced by a reducing valve 72 to balance out the weight of the rider roll wheels 15', 15", . . . in operation as mentioned above.

Depending on the number of rider roll wheels used to load the wound roll(s), the rider roll wheels 15', 15", . . . are groupwise (only one rider roll wheel of each group is shown in FIG. 4) connected to the seperate manifolds 61A (all wheels), 61C (half of wheels) 61D (for example three wheels) and 61E (for example two wheels).

For preparing the rider roller assembly for a new roll-set pattern, manifold 61A is set under pressure and subsequently the manual valves 66', 66", . . . of the rider roll wheels which are not used for the new set of rolls to be wound, i.e. the wheels in the slit area of adjacent rolls, are closed. Thereby, the rider roll wheels which are not used are moved and kept in the extreme up-position not engaging the wound roll(s).

All other wheels must now be moved to these midstroke position in order to fill the hydraulic system with the necessary quantitiy of hydraulic fluid. For this initializing step, shut-off valve 53 is opened to combine the hydraulic cylinders 25 with reservoir 51. Subsequently, the manifolds 61A and 61B are set pressureless by means of the solenoid valves 71A (closed) while at least some of the manifolds 61C, 61D and 61E are set under pressure by solenoid valves 71B, 71C, 71D (opened). These manifolds are selected according to the following scheme: about half of the rider roll wheels used for winding should stay in the extreme down-position whereas the other halb of the necessary rider roll wheels should move to the extreme up-position. Subsequently, shut-off valve 53 is closed, retaining the correct amount of fluid in the hydraulic cycle to position all used rider roll wheels to midstroke position.

During operation, only the reduced pressure of manifold 61B is applied to the cylinder chambers 26', 26", . . . of the used rider roll wheels 15', 15", . . . for weight compensating while manifolds 61A, 61C, 61D and 61E are pressureless.

The pneumatic/hydraulic system capable of being optionally used with the invention is simplificated in relation to prior ones and easier and cheaper in installation.

With a rider roll wheel arrangement according to the invention, a programmed, full automatic winding tension depending on the diameter of the given wound roll is possible without the further use of any kind of valves. Only for lifting the rider roll wheels in the area of the gap or slit between adjoining webs of material is it necessary to actuate a few valves in order to overcome the hydraulic fluid pressure.

We claim:

1. Rider roll assembly for applying nip loading force to at least one roll of web-like material, such as at least one roll of paper being wound on a winder, said winder including at least one supporting or carrier drum, which supports or carries the roll being wound about the axis of rotation of the roll, comprising:

a beam (16) being translationally movable substantially vertically relative to the wound roll depending on the diameter thereof, driving means for moving the beam;

the rider roll assembly including a plurality of rider roll wheels, which are mounted to the beam (16) and are individually pivotable and are structured for engaging the wound roll along a contact line (nip line (20));

supporting arms (17', 17", . . . ), articulately linked with the beam for supporting and individually pivoting the rider roll wheels (15', 15", . . . ) on a swiveling axis (18) in relation to the beam (16);

means for fluidly loading the rider roll wheels (15', 15", . . . ) against the at least one wound roll;

means for fluidly loading or lifting the rider roll wheels (15', 15", . . . ) from the at least one wound roll and counter-balancing the weight of the rider roll wheels and the supporting arms, characterized in that the means for loading and for lifting or relieving each of the rider roll wheels (15', 15", . . . ) are combined in corresponding double acting piston/cylinder units (23', 23", . . . ), each with a single-sided piston rod (22', 22", . . . ); further comprising at least one pressure spring means (37', 37", . . . ) linked between the beam (16) and the supporting arms (17', 17", . . . ) counter-acting the weight-related torque acting between the rider roll wheels (15', 15", . . . ) and corresponding supporting arms (17', 17". . . ).

2. Rider roller assembly according to claim 1, characterized in that a compensating means (36', 36", . . . ) is inserted between the free ends of the piston rods and the supporting arms (17', 17", . . . ) of the rider roll wheels (15', 15", . . . ), which enables a relative movement between the supporting arm and the piston rod in the radial direction of the piston rod independently of the axial movement of the piston rod (22', 22", . . . ).

3. Rider roller assembly according to claim 1, characterized in at least one diaphragm (27', 27", . . . ; 28', 28", . . . ) fluidly seperating the cylinder chambers (25', 25", . . . ; 26', 26", . . . ) at both sides of each piston (24', 24", . . . ) of each double-way acting piston/cylinder unit (23', 23", . . . ).

4. Rider roll assembly according to claim 1, characterized in that a spring package (34) acting as a shock absorber is linked coaxially to each piston rod (22', 22", . . . ) and serving for overload protection, and is inserted between the beam (16) and each double-way acting piston/cylinder units (23', 23". . . .).

* * * * *